US009726046B2

(12) United States Patent
Guo

(10) Patent No.: US 9,726,046 B2
(45) Date of Patent: Aug. 8, 2017

(54) ROTOR HIGH-AND-LOW PRESSURE POWER APPARATUS AND WORKING METHOD THEREOF

(71) Applicant: Yuanjun Guo, Yongzhou (CN)

(72) Inventor: Yuanjun Guo, Yongzhou (CN)

(73) Assignee: Yuanjun Guo, Yongzhou (CN)

( * ) Notice: Subject to any disclaimer, the term of this patent is extended or adjusted under 35 U.S.C. 154(b) by 0 days.

(21) Appl. No.: 15/307,834

(22) PCT Filed: Sep. 23, 2014

(86) PCT No.: PCT/CN2014/087196

§ 371 (c)(1),
(2) Date: Oct. 31, 2016

(87) PCT Pub. No.: WO2015/165199

PCT Pub. Date: Nov. 5, 2015

(65) Prior Publication Data

US 2017/0051633 A1 Feb. 23, 2017

(30) Foreign Application Priority Data

Apr. 30, 2014 (CN) ..... 2014 1 0177354

(51) Int. Cl.
*F01K 13/00* (2006.01)
*F01K 7/00* (2006.01)

(52) U.S. Cl.
CPC ..... *F01K 7/00* (2013.01)

(58) Field of Classification Search
CPC ..... F01K 7/00; F01K 7/04; F01K 3/02; F01K 3/18; F01K 23/064; F01K 23/065; F01K 13/006
USPC ..... 60/645, 641.2
See application file for complete search history.

(56) References Cited

FOREIGN PATENT DOCUMENTS

| | | | |
|---|---|---|---|
| CN | 2732998 | Y | 10/2005 |
| CN | 102477936 | A | 5/2012 |
| CN | 203515677 | U | 4/2014 |
| CN | 103912324 | A | 7/2014 |
| CN | 203891947 | U | 10/2014 |
| WO | WO2008/107547 | A1 | 9/2008 |

*Primary Examiner* — Jason Shanske
*Assistant Examiner* — Kelsey Stanek
(74) *Attorney, Agent, or Firm* — Gokalp Bayramoglu

(57) ABSTRACT

A rotor high-and-low pressure power apparatus, comprises a heat collector, an insulating pipe, a gasification reactor, an atomizer, a cylinder, a triangular rotor, an inner gear ring, a gear, an output shall, a one-way an intake valve, a liquid storage tank, a pressure valve, an insulating layer, an automatic exhaust valve, a housing, a heat sink and an exhaust control valve. The triangular rotor is arranged within the housing. The inner gear ring and the gear matching with the inner gear ring are arranged at the center of the triangular rotor. The gear is fixed on the output shaft. The triangular rotor divides the cylinder into three independent and equal sections. The gear ratio of the inner gear ring and the gear is 3:2. The rotor provided with a rotor engine works three times per rotation. The ratio of horsepower to volume is high.

5 Claims, 1 Drawing Sheet

ROTOR HIGH-AND-LOW PRESSURE POWER APPARATUS AND WORKING METHOD THEREOF

CROSS REFERENCE TO RELATED APPLICATIONS

This application is a national phase entry of International Application No. PCT/CN2014/087196, flied on Sep. 23, 2014, which is based upon and claims priority to Chinese Patent Application No. 2014101773.543, filed on Apr. 30, 2014, the entire contents of which are incorporated herein by reference.

TECHNICAL FIELD

The invention relates to the field of thermal energy power equipment, especially the power machine which can convert heat energy from the solar energy, the geothermal, the high-temperature gas generated by burning of combustibles, the thermal energy or the exhaust gas of internal combustion engine, and the high-temperature gas discharged from factory into the kinetic energy.

BACKGROUND

Conventional power equipment includes the steam engines, internal combustion engines, and external combustion engines.

Steam engine: It cannot work without the boiler. The whole machine is heavy and large. The pressure and the temperature of the steam cannot be too high, and the exhaust pressure cannot be too low. The heat efficiency is hard to improve. It is a reciprocating machine. The inertia restrains the improvement of the rotational speed. The working is not continuous. The flow of steam is restrained, which limits the improvement of the power.

Internal combustion engine: It has a complicated structure, a high requirement of fuel, and strict requirement of the cleanliness of fuel. It pollutes the environment.

External combustion engine: For example, Stirling engine is one kind of external combustion engine. Compared with internal combustion engine, Stirling engine has the following advantages:

It is suitable for all kinds of energy, not matter what state the energy fuel is, liquid, gas, or solid. When using the heat-carrying system (e.g., heat pipe) to heat indirectly, almost all high-temperature heat source (e.g., solar radioactive isotope and nuclear reaction) can be used, while the engine itself (except the heater) does not need any change. At the same time, Stirling engine does not need a compressing machine to increase the pressure, which can be met by an ordinary fan. The fuel with relatively high impurity content is allowed. The unit capacity of Stirling engine is small, the capacity of which is ranges from 20 to 50 kw. The system capacity can be increased or reduced based on local conditions. The structure is simple. The number of parts of the external combustion engine is 40% less than that of an internal combustion engine. It has a significant margin of price discount and a low maintenance cost.

When Stirling engine is running, the fuel is burning continuously in the combustion chamber which is outside the cylinder. The working medium, which is independent from the gas, absorbs the heat from the heater and works with respect to the outside on the basis of the Stirling cycle. Thus, the knocking and intermittent combustion of the internal combustion engine and the like are avoided. An efficient, less noisy, and low-exhaust operation is realized. As being efficient, the total energy efficiency reaches more than 80%. As being less noisy, the noise at a place which is one meter from the bare machine is lower than 68 dBA. As being low-exhaust, the emission of tail gas meets the standard of Euro 5.

Since the working medium does not burn, the external combustion engine avoids the problem of knocking of the conventional internal combustion engine, such that high efficiency, low-noise, low-polluting, and low-running-cost are realized. The external combustion engine can burn various gasses, natural gas, biogas, petroleum gas, hydrogen, gas, etc. Liquid fuels like diesel, liquefied petroleum gas, etc. can also be used. Burning woods, the solar energy, etc. can also be used. As long as the temperature of the hot chamber reaches 700° C., the equipment will run and work. The lower the environmental temperature, the higher will be the efficiency of the power generation. The most remarkable advantage of the external combustion engine is that the output and efficiency are not affected by the altitude, which makes it very suitable to use in high-altitude areas.

Meanwhile, the mainly existing problems and defects of Stirling engine are as follows. The manufacturing cost is high. The working medium sealing technology is difficult. The reliability and serving life of the sealing part have problems. The material cost is high. The power adjusting control system is complex. The machine is heavy. The costs of the expansion chamber, the compression chamber, the heater, the cooling chamber, the regenerator, etc. are high. The heat loss is twice to three times than that of an internal combustion engine.

Organic Rankine Cycle system includes a pump, an evaporator, an expander, a generator, a condenser, etc. The heat collector absorbs the solar irradiation. The temperature of the heat exchanging medium inside the heat collector increases. The heat is transmitted to the organic working medium from the heat exchanging medium through the evaporator. The organic working medium is heated in the evaporator under a constant pressure. The gaseous organic working medium with a high pressure enters the expander to work through expanding, so as to drive the generator to generate power. The organic working medium discharged from the tail of the expander enters the condenser to condense under a constant pressure. After increasing the pressure by the pump, the organic working medium output from the condenser enters the evaporator, such that one power generation cycle is completed.

Organic Rankine Cycle system has the following defects. The conversion efficiency is low. The size is huge. The expander which has a complex structure is essential to work.

The comparison between the rotor generator and the conventional reciprocating generator is as follows. Both the reciprocating generator and the rotor generator obtain the rotating power from the expanding pressure generated by burning the air fuel of mixed gas. The structural difference between these two types of generator lies in how to use the expanding pressure. In the reciprocating generator, the expanding pressure generated on the surface of the top of the piston pushes the piston downwards. The mechanical force is transmitted to the connecting rod to drive the bent axle to rotate. For the rotor generator the expanding pressure applies on the side of the rotor, to push one of the three surfaces of the triangular rotor to the center of the eccentric shaft. Such a motion is performed under two components of force. One component of force is the centripetal force oriented to the center of the output shaft. The other component of force is the tangential force (Ft) which chives the output shaft to rotate.

Ordinary generator is the reciprocating generator. During working, the piston moves back and forth. In order to convert the linear movement of the piston into a rotation, a slider-crank mechanism is necessary. Different from that, the rotor generator directly convert the expanding pressure of the burning gas into the torque of the rotation. Compared with the reciprocating generator, the useless linear movement is eliminated. Thus, the rotor generator with the same power has a small size, light weight, less vibration, and low noise. It has significant advantages.

The features of the rotor generator are as follows. While the triangular rotor is rotating around a center of the triangular rotor, the center of the triangular rotor rotating around the output shaft at the same time. The inner gear ring whose center is the center of the triangular rotor engaging the gear whose center is a center of the output shall. The gear is fixed to the cylinder and does not rotate. The gear ratio of the inner gear ring and the gear is 3:2. The above motion relation makes a motion trail of a vertex of the triangular rotor (which is a shape of a wall of the cylinder) is in a shape of "8". The triangular rotor divides the cylinder into three independent sections. The three sections go through air intaking, compressing, working, and exhausting respectively. When the triangular rotor rotates once, the generator ignites and works three times. Due to the above motioned relation, a rotating speed of the output shaft is three times of a rotating speed of the rotor, which is totally different from the reciprocating generator whose motion relation is 1:1 of the piston and the bent shaft.

Advantages of the rotor generator are as follows. The rotor of the rotor engine works three times per rotation. Compared with ordinary four-stroke engine which works once per tow rotations, it has the advantage of a high ratio of horsepower to volume (which means the engine can output more power with a small volume). Moreover, due to the characteristic of axial directional motion of the rotor engine, it can reach a high rotating speed without the precise balance of the bent shaft. In the entire engine, only two transmission parts are included. The structure is significantly simplified, compared with ordinary four-stroke engine which includes more than twenty moving parts including air intake/outtake valve, etc. The likelihood of breaking down is notably reduced. Besides, the advantages of the rotor engine further include small volume, light weight, low gravity center, and less vibration.

Disadvantages are as follows. The fuel consumption is high. The pollution is heavy. Since the compression ratio is not as high as the reciprocating generator, the combustion is not thorough in the rotor generator. Although Mazda Company has added devices like one-stage turbine, one-stage turbine, etc., the output horsepower is increased, and the exhaust gas emission reduced to certain extent. However, it has a remarkable difference from the reciprocating generator. The abrasion is serious, which causes short lifetimes of the parts. Since there is only one radial sealing sheet between adjacent chambers of the triangular rotor engine, the radial sealing sheet always contacts the body of the cylinder linearly. Moreover, the location where the radial sealing sheet always contacts the body of the cylinder is changing all the time. Thus, the three combustion chambers are not completely separated (sealed). The abrasion of the radial sealing sheet is quick. After some time of using the engine is subjected to the problem of gas leaking due to the abrasion of the oil sealing material. The fuel consumption and the pollution is increased sharply. The special mechanical structure results that it is difficult to repair such kind of engines.

SUMMARY

The invention overcomes the existing problem that the costs of the expansion chamber, the compression chamber, the heater, the cooling chamber, the regenerator, etc. are high. The invention overcomes the existing problem that the heat loss is twice to three times than that of an internal combustion engine. The invention overcomes the technical difficulty that Organic Rankine Cycle system needs an expander or a steam turbine, which renders a high manufacturing cost. The invention overcomes the problem that internal combustion radial engine has a complex structure and a high manufacturing cost. The invention provides a high-and-low pressure power apparatus which is heat power equipment that uses the structure of existing engine and combines the advantages of Stirling engine and Organic Rankine Cycle system. After heat is absorbed by the heat collector, the gasification reactor is heated, to make the working medium gasify and expand under a high temperature to push the triangular rotor to move forward to work. After the heat energy is absorbed, the cylinder is heat-dissipated and cooled down to generate negative pressure to draw the triangular rotor to work.

The invention provides a rotor high-and-low pressure power apparatus which has a high heat conversion efficiency, in which the working medium is recycled, the output power within the maximum power range is adjustable by adjusting the amount of the working medium, the output power is adjustable by adjusting the temperature, and the machine output power is stable.

The technical solution of the invention is: a rotor high-and-low pressure power apparatus, includes heat collector, insulating pipe, gasification reactor, atomizer, cylinder, triangular rotor, inner gear ring, gear, output shaft, one-way an intake valve, liquid storage tank, pressure valve, insulating layer, automatic exhaust valve, housing, heat sink, and exhaust control valve. Triangular rotor is arranged inside the housing. The inner gear ring and the gear matching the inner gear ring are arranged at a center of the triangular rotor. The gear is fixed on the output shaft. The triangular rotor divides the cylinder into three independent and equal sections. A gear ratio of inner gear ring and gear is 3:2. The gasification reactor and exhaust control valve are arranged on one side of the cylinder. The automatic exhaust valve and the one-way air intake valve are arranged on the other side of the cylinder. The heat collector is connected to the gasification reactor through the insulating pipe. The atomizer is arranged on an air inlet end of the gasification reactor. The atomizer is connected to the pressure valve through the pipe. The pressure valve is connected to the liquid storage tank through the pipe. The gasification reactor is arranged on an air inlet of the cylinder. The automatic exhaust valve and the exhaust control valve are arranged on an air outlet of the cylinder. The side of the cylinder on which automatic exhaust valve is arranged is connected to the one-way air intake valve which is arranged on the same side of the cylinder through the buffer pipe. The exhaust control valve which is arranged on the other side is connected to the liquid storage tank through the pipe. An upper portion of the cylinder is provided with the insulating layer. A lower portion of the cylinder is provided with the heat sink.

Further, the heat collector can absorb solar energy, geothermal energy, high-temperature gas generated by burning of a combustible, exhaust gas of an internal combustion engine, high-temperature gas discharged from a factory.

Further, the gasification reactor includes a pressure vessel, a gasification conducting strip, a plurality of gas hole, and an atomizer. The gasification conducting strip is arranged on the pressure vessel. A plurality of gas holes is arrayed on the gasification conducting strip. The atomizer is arranged on an air inlet end of the pressure vessel.

Further, the pressure valve is associated with the output shaft. The pressure valve opens and closes three times whenever a circulation is completed.

A working method of the above rotor high-and-low pressure power apparatus is: while the triangular rotor is rotating around a center of the triangular rotor, the center of the triangular rotor rotating around the output shaft at the same time. The inner gear ring whose center is the center of the triangular rotor engaging the gear whose center is a center of the output shaft. The gear is fixed to the cylinder and does not rotate. The gear ratio of the inner gear ring and the gear is 3:2. The above motion relation makes a motion trail of a vertex of the triangular rotor which is a shape of a wall of the cylinder is in a shape of "8". The triangular rotor divides the cylinder into three independent sections. The three sections go through air intaking, working respectively. The triangular rotor works three times per rotation. Due to the above motion relation, a rotating speed of the output shaft is three rimes of a rotating speed of the rotor. The heat collector absorbs solar energy, geothermal energy, high-temperature gas generated by burning a combustible, heat energy or exhaust gas of an internal combustion engine, high-temperature gas discharged from a factory, or other heat energy. The heat is transmitted to a gasification reactor directly or via a pipe. The pipe is provided with flowing heat conducting medium, liquid working medium is injected through the pressure valve into the gasification reactor to be atomized. The atomized working medium is gasified and expanded by the gasification reactor. The automatic exhaust valve opens when the triangular rotor turns to the automatic exhaust valve. The working gas is discharged through the automatic exhaust valve. The discharged gaseous working medium enters another independent section through the one-way air intake valve. Heated gas inside the cylinder is heat-dissipated and cooled down via the heat sink. The triangular rotor is drawn by negative pressure generated in the cylinder to move forward to work. The exhaust control valve opens when an end of the triangular rotor rotates over the exhaust control valve. The cooled-down gas or liquid is discharged through the exhaust control valve. The triangular rotor rotates in the cylinder to work to drive the output shaft to output kinetic energy.

The advantages of the invention are as follows: 1). The rotor provided with a rotor engine works three times per rotation. The ratio of horsepower to volume is high. 2). The speed of operating rotation is high. The volume is relatively small. The weight is light. The center of gravity is low. The vibration is low. 3). The working medium is recycled, and there is no pollution. 4). The heat energy conversion efficiency is 65%-98%. 5). The output power can be adjusted by adjusting the capacity and number of the machine cylinder as per desired power. 6). the output power can be adjusted within the maximum power range by adjusting the injecting liquid. 7). During the entire process of gasifying the working medium to work, no knocking is generated. 8). Conventional energy consumption can be replaced, which is economically efficiency, energy-saving, environment friendly, and less noisy.

Figure 1:
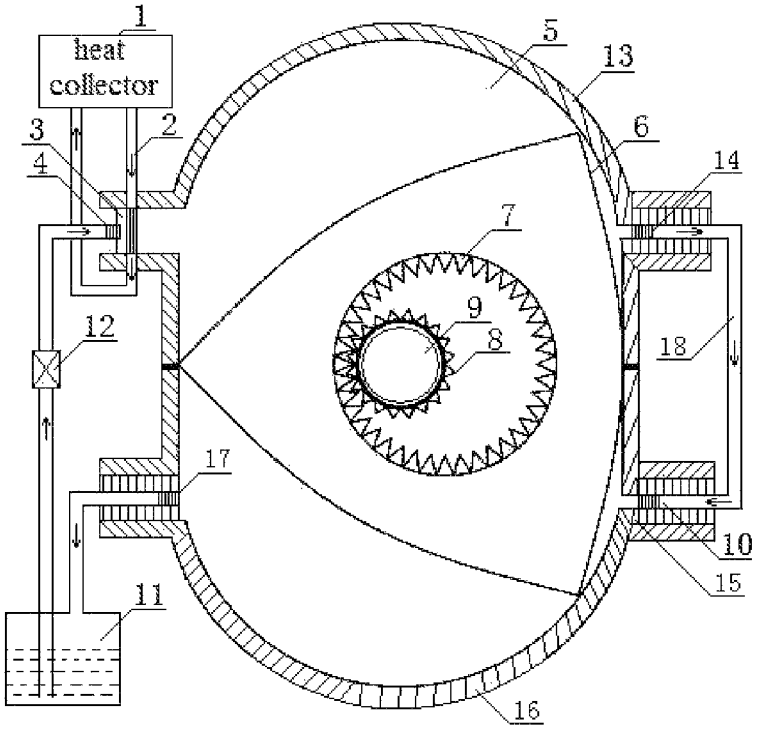
FIG. 1 is the structural schematic diagram of the invention.
Figure 2:
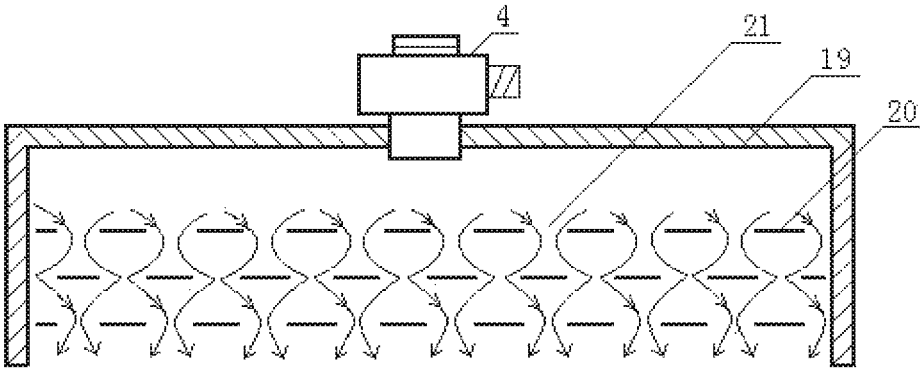
FIG. 2 is the structural diagram of the gasification reactor of the invention.

In figures: 1 is a heat collector; 2 is an insulating pipe; 3 is a gasification reactor; 4 is an atomizer; 5 is a cylinder; 6 is a triangular rotor; 7 is an inner gear ring; 8 is a gear; 9 is a output shaft; 10 is a one-way air intake valve; 11 is a liquid storage tank; 12 is a pressure valve; 13 is an insulating layer; 14 is an automatic exhaust valve; housing 15 is a housing; 16 is a heat sink; 17 is an exhaust control valve; 18 is a buffer pipe; 19 is a pressure vessel; 20 is a gasification conducting strip; 21 is a gas hole.

DETAILED DESCRIPTION

Referring to the figures, Embodiments of the invention are as follows:

Embodiment 1

A rotor high-and-low pressure power apparatus, includes heat collector 1, insulating pipe 2, gasification reactor 3, atomizer 4, cylinder 5, triangular rotor 6, inner gear ring 7, gear 8, output shaft 9, one-way air intake valve 10, liquid storage tank 11, pressure valve 12, insulating layer 13, automatic exhaust valve 14, housing 15, heat sink 16, exhaust control valve 17, and buffer pipe 18. Triangular rotor 6 is arranged inside housing 15. Inner gear ring 7 and gear 8 matching inner gear ring 7 are arranged at a center of triangular rotor 6. Gear 8 is fixed on output shaft 9. Triangular rotor 6 divides cylinder 5 into three independent and equal sections. A gear ratio of inner gear ring 7 and gear 8 is 3:2. Gasification reactor 3 and exhaust control valve 17 are arranged on one side of cylinder 5. Automatic exhaust valve 14 and one-way air intake valve 10 are arranged on the other side of cylinder 5. Heat collector 1 is connected to gasification reactor 3 through insulating pipe 2. Atomizer 4 is arranged on an air inlet end of gasification reactor 3. Atomizer 4 is connected to pressure valve 12 through the pipe. Pressure valve 12 is connected to liquid storage tank 11 through the pipe. Gasification reactor 3 is arranged on an air inlet of cylinder 5. Automatic exhaust valve 14 and exhaust control valve 17 are arranged on an air outlet of cylinder 5. The side of cylinder 5 on which automatic exhaust valve 14 is arranged is connected to one-way air intake valve 10 which is arranged on the same side of the cylinder through buffer pipe 18. Exhaust control valve 17 which is arranged on the other side is connected to liquid storage tank 11 through the pipe. An upper portion of cylinder 5 is provided with insulating layer 13. A lower portion of cylinder 5 is provided with heat sink 16.

Embodiment 2

The rotor high-and-low pressure power apparatus as described in Embodiment 1, gasification reactor 3 includes pressure vessel 19, gasification conducting strip 20, gas hole 21, and atomizer 4. Gasification conducting strip 20 is arranged on pressure vessel 19. A plurality of gas holes 21 are arrayed on gasification conducting strip 20. Atomizer 4 is arranged on the air inlet end of pressure vessel 19. Pressure valve 12 opens and closes three times whenever circulation is completed.

What is claimed is:

1. A rotor high-and-low pressure power apparatus, comprising a heat collector, an insulating pipe, a gasification reactor, an atomizer, a cylinder, a triangular rotor, an inner gear ring, a gear, an output shaft, a one-way air intake valve, a liquid storage tank, a pressure valve, an insulating layer, an automatic exhaust valve, a housing, a heat sink, and an exhaust control valve;

wherein the triangular rotor is arranged inside the housing;

wherein the inner gear ring and the gear matching the inner gear ring are arranged at a center of the triangular rotor;

wherein the gear is fixed on the output shaft;

wherein the triangular rotor divides the cylinder into three independent and equal sections;

wherein a gear ratio of the inner gear ring and the gear is 3:2;

wherein the gasification reactor and the exhaust control valve are arranged on one side of the cylinder;

wherein the automatic exhaust valve and the one-way air intake valve are arranged on an other side of the cylinder;

wherein the heat collector is connected to the gasification reactor through the insulating pipe;

wherein the atomizer is arranged on an air inlet end of the gasification reactor;

wherein the atomizer is connected to the pressure valve;

wherein the pressure valve is connected to the liquid storage tank;

wherein the gasification reactor is arranged on an air inlet of the cylinder;

wherein the automatic exhaust valve and the exhaust control valve are arranged on an air outlet of the cylinder;

wherein the side of the cylinder on which the automatic exhaust valve is arranged is connected to the one-way air intake valve which is arranged on the same side of the cylinder through a buffer pipe;

wherein the exhaust control valve which is arranged on the other side is connected to the liquid storage tank;

wherein an upper portion of the cylinder is provided with the insulating layer;

wherein a lower portion of the cylinder is provided with the heat sink.

2. The rotor high-and-low pressure power apparatus of claim 1, wherein, the heat collector can absorb solar energy, geothermal energy, high-temperature gas generated by burning of a combustible, exhaust gas of an internal combustion engine, or high-temperature gas discharged from a factory.

3. The rotor high-and-low pressure power apparatus of claim 1, wherein, the gasification reactor includes a pressure vessel, a gasification conducting strip, and a plurality of gas holes;

wherein the gasification conducting strip is arranged on the pressure vessel;

wherein a plurality of gas holes are arrayed on the gasification conducting strip; and wherein the atomizer is arranged on an air inlet end of the pressure vessel.

4. The rotor high-and-low pressure power apparatus of claim 1, wherein, the pressure valve is associated with the output shaft;

wherein the pressure valve opens and closes three times whenever a circulation is completed.

5. A method of using a rotor high-and-low pressure power apparatus, wherein the rotor high-and-low pressure power apparatus comprises a heat collector, insulating pipe, a gasification reactor, an atomizer, a cylinder, a triangular rotor, an inner gear ring, a gear, an output shaft, a one-way air intake valve, a liquid storage tank, a pressure valve, an insulating layer, an automatic exhaust valve, a housing, a heat sink, and an exhaust control valve;

wherein the triangular rotor is arranged inside the housing;

wherein the inner gear ring and the gear matching the inner gear ring are arranged at a center of the triangular rotor;

wherein the gear is fixed on the output shaft;

wherein the triangular rotor divides the cylinder into three independent and equal sections;

wherein a gear ratio of the inner gear ring and the gear is 3:2;

wherein the gasification reactor and exhaust control valve are arranged on one side of the cylinder;

wherein the automatic exhaust valve and the one-way air intake valve are arranged on an other side of the cylinder;

wherein the heat collector is connected to the gasification reactor through the insulating pipe;

wherein the atomizer is arranged on an air inlet end of the gasification reactor;

wherein the atomizer is connected to the pressure valve;

wherein the pressure valve is connected to the liquid storage tank;

wherein the gasification reactor is arranged on an air inlet of the cylinder;

wherein the automatic exhaust valve and the exhaust control valve are arranged on an air outlet of the cylinder;

wherein the side of the cylinder on which the automatic exhaust valve is arranged is connected to the one-way air intake valve which is arranged on the same side of the cylinder through a buffer pipe;

wherein the exhaust control valve which is arranged on the other side is connected to the liquid storage tank;

wherein an upper portion of the cylinder is provided with the insulating layer;

wherein a lower portion of the cylinder is provided with the heat sink;

wherein the triangular rotor rotates around a center of the triangular rotor, while the center of the triangular rotor rotates around the output shaft at the same time;

wherein the inner gear ring whose center is the center of the triangular rotor engages the gear whose center is a center of the output shaft;

wherein the gear is fixed to the cylinder and does not rotate;

wherein a motion trail of a vertex of the triangular rotor which is a shape of a wall of the cylinder is in a shape of "8";

wherein the three sections go through air intaking and working in turns respectively;

wherein the triangular rotor works three times per rotation;

wherein a rotating speed of the output shaft is three times of a rotating speed of the rotor;

wherein the method comprises, absorbing, by the heat collector, solar energy, geothermal energy, high-temperature gas generated by burning a combustible, heat energy or exhaust gas of an internal combustion engine, high-temperature gas discharged from a factory, or other heat energy;

transmitting the heat to the gasification reactor directly or via the insulating pipe, wherein the insulating pipe is provided with flowing heat conducting medium;

injecting, through the pressure valve, liquid working medium into the gasification reactor to be atomized;

gasifying and expanding, by the gasification reactor, the atomized working medium;

opening the automatic exhaust valve when the triangular rotor turns to the automatic exhaust valve;

discharging the working gas through the automatic exhaust valve;

entering the discharged gaseous working medium into another independent section through the one-way air intake valve;

heat-dissipating and cooling down heated gas inside the cylinder via the heat sink;

drawing, by a negative pressure generated in the cylinder, the triangular rotor to move forward to work;

opening the exhaust control valve when an end of the triangular rotor rotates over the exhaust control valve;

discharging the cooled-down gas or liquid through the exhaust control valve; and rotating the triangular rotor in the cylinder to work to drive the output shaft to output kinetic energy.

* * * * *